US005982347A

United States Patent [19]

Shigeta et al.

[11] Patent Number: 5,982,347

[45] Date of Patent: Nov. 9, 1999

[54] DRIVE CIRCUIT FOR COLOR DISPLAY DEVICE

[75] Inventors: Kazuyuki Shigeta, Isehara; Makoto Matsuura, Kanagawa-ken, both of Japan

[73] Assignee: Canon Kabushiki Kaisha, Tokyo, Japan

[21] Appl. No.: 08/655,893

[22] Filed: May 31, 1996

[30] Foreign Application Priority Data

| | | | |
|---|---|---|---|
| Jun. 1, 1995 | [JP] | Japan | 7-156648 |
| Jun. 1, 1995 | [JP] | Japan | 7-156649 |
| May 28, 1996 | [JP] | Japan | 8-154791 |

[51] Int. Cl.[6] ..... G09G 3/36

[52] U.S. Cl. ..... 345/88; 345/98; 345/94

[58] Field of Search ..... 345/98, 99, 100, 345/88, 152, 94, 196, 197

[56] References Cited

U.S. PATENT DOCUMENTS

| | | | |
|---|---|---|---|
| 4,845,473 | 7/1989 | Matsuhashi et al. | 345/94 |
| 5,418,547 | 5/1995 | Mizukata et al. | 345/98 |
| 5,488,389 | 1/1996 | Nakanishi et al. | 345/515 |
| 5,579,027 | 11/1996 | Sakurai et al. | 345/99 |
| 5,602,561 | 2/1997 | Kawaguchi et al. | 345/99 |
| 5,682,175 | 10/1997 | Kitamura | 345/99 |
| 5,682,176 | 10/1997 | Matino | 345/99 |

*Primary Examiner*—Steven J. Saras
*Assistant Examiner*—Amr Awad
*Attorney, Agent, or Firm*—Fitzpatrick, Cella, Harper & Scinto

[57] ABSTRACT

A drive circuit for a color display device comprising a plurality of pixels which are wired in matrix through a plurality of data signal lines and a plurality of scanning signal lines; the drive circuit comprising an input means for sampling three-primary color image signals for one line which are inputted through three input lines during a given period t, to write the signals in a memory, and an output means for reading the three-primary color image signals during a certain t/2 period to output the signals to three output lines, and reading the three-primary color image signals during an additional t/2 period different from the certain t/2 period to output the signals to the three output lines. When the drive circuit is used in, e.g., an active matrix liquid-crystal display device, display can be free of flicker and can be in a high resolution.

15 Claims, 20 Drawing Sheets

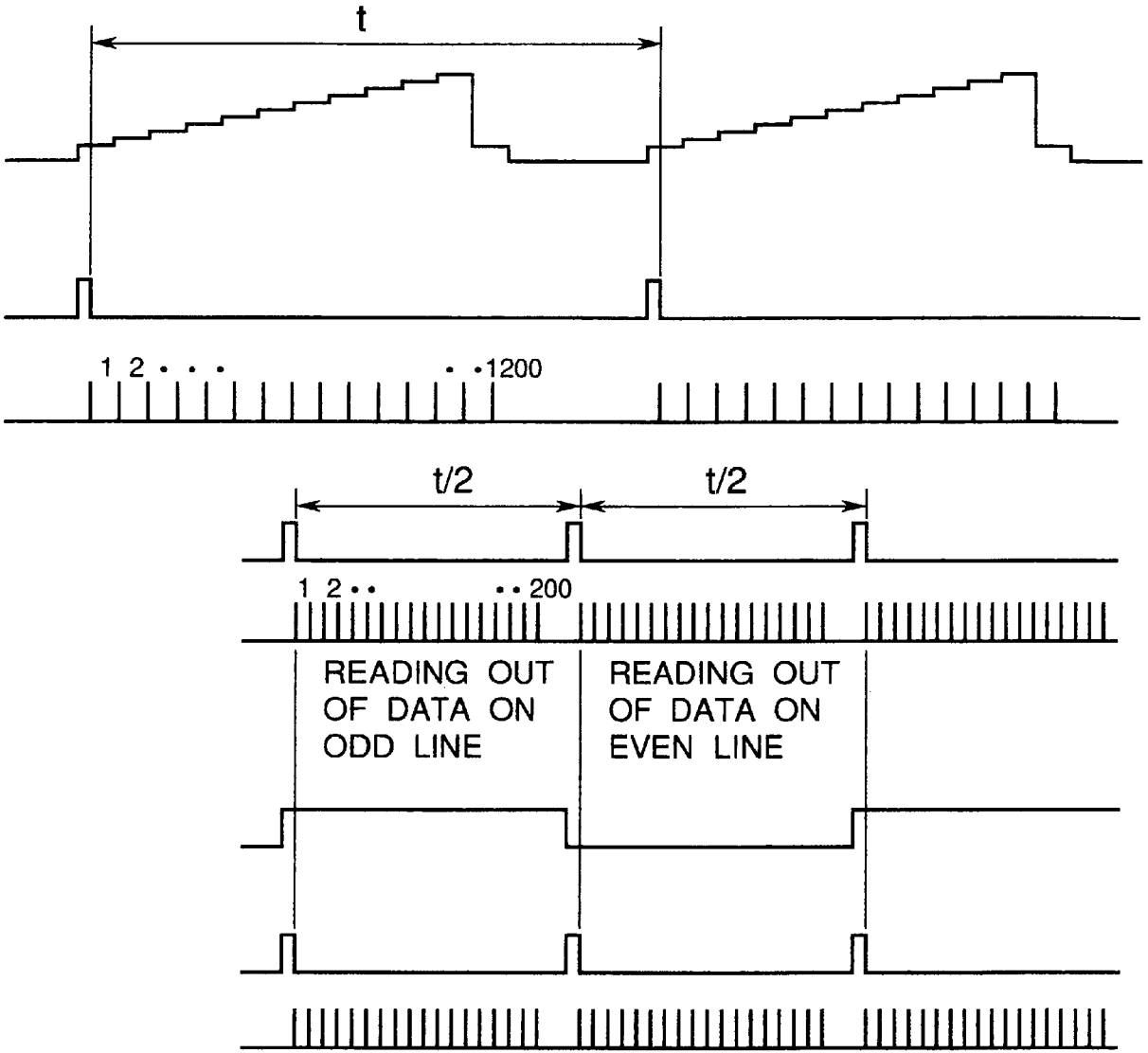
FIG.18A SIG1
FIG.18B SIG2
FIG.18C SIG3
FIG.18D SIG4
FIG.18E SIG5
FIG.18F SIG6
FIG.18G SIG7
FIG.18H SIG8

DRIVE CIRCUIT FOR COLOR DISPLAY DEVICE

BACKGROUND OF THE INVENTION

1. Field of the Invention

This invention relates to a drive circuit for display devices used as devices for displaying television pictures or computer output images, and more particularly to a drive circuit for liquid-crystal color display devices.

2. Related Background Art

FIG. 7 illustrates the constitution of a system of liquid-crystal display devices conventionally used. In FIG. 7, reference numeral 1 denotes a signal input terminal from which television signals or the like are fed; 2, a decoder which converts them into red (R), green (G) and blue (B) color signals; 4, a reversal control and signal amplifying part where the signals are successively forward-backward changed at given intervals into signals for liquid-crystal driving; and 5, a logic part where pulses for reverse control and liquid-crystal display panel driving are formed. Reference numeral 6 denotes a liquid-crystal display panel, of which reference numeral 7 denotes a horizontal shift register (HSR) serving as a horizontal-direction scanning means; 8, a vertical shift register (VSR) serving as a vertical-direction scanning means; and 9, a pixel area.

In general, TN type or STN type liquid crystals are said to have a response speed of several to several tens of ms. Hence, when interlaced scanning is performed in liquid-crystal display devices in the same way as in CRTs, the scanning can not follow a swift movement of the picture, resulting in a lowering of dynamic resolution. Meanwhile, when the interlaced scanning is performed, signals are written in the same pixel at a cycle of 30 Hz, and, taking account of the reversal of signal polarity which is done so as to prevent the liquid crystal from burning, liquid-crystal signals with the same polarity are written at a cycle of 15 Hz. The lowering of hold potential at the pixel area and the asymmetry of signals with respect to common electrodes cause a change in brightness of the picture at this cycle, so that, since human's eyes are sensitive to flickering of 30 Hz or below, flicker occurs to cause a lowering of image quality.

To solve such problems in interlaced scanning, a method is known in which the signal on the n-th line in the even-numbered field on the even-numbered field and the signal on the n-th line in the odd-numbered field on the odd-numbered field are written in the same line of the liquid-crystal display panel. The signals thus written in each line for each field on the liquid-crystal display panel are shown in Table 1 below. Here, $O_n(m)$ indicates data that is sampled at the timing where the signal on the n-th line in the odd-numbered field, of interlacing signals on an m-th frame is matched to the pixel arrangement of the display panel. In this instance, signals are written in the same pixel at a cycle of 60 Hz, and human's eyes can not follow the change in brightness of the picture at this cycle, so that the lowering of image quality caused by flicker does not occur. Also, since the whole picture is rewritten at 60 Hz, the scanning can follow the swift change of the picture.

TABLE 1

| Pixel line | 1st-field | 2nd-field | 3rd-field | 4th-field |
|---|---|---|---|---|
| n−2 line | $O_{n-2}(1)$ | $E_{n-2}(1)$ | $O_{n-2}(2)$ | $E_{n-2}(2)$ |
| n−1 line | $O_{n-1}(1)$ | $E_{n-1}(1)$ | $O_{n-1}(2)$ | $E_{n-1}(2)$ |

TABLE 1-continued

| Pixel line | 1st-field | 2nd-field | 3rd-field | 4th-field |
|---|---|---|---|---|
| n line | $O_n(1)$ | $E_n(1)$ | $O_n(2)$ | $E_n(2)$ |
| n+1 line | $O_{n+1}(1)$ | $E_{n+1}(1)$ | $O_{n+1}(2)$ | $E_{n+1}(2)$ |
| n+2 line | $O_{n+2}(1)$ | $E_{n+2}(1)$ | $O_{n+2}(2)$ | $E_{n+2}(2)$ |

Another method is also known in which, using a frame memory, the signal of an interlaced even-numbered field and the signal of an interlaced odd-numbered field are synthesized into a single image on the memory, and the synthesized image is converted into a line-sequential scanning signal and displayed at 60 Hz. In this instance, the same image signal is consecutively displayed for two fields. The signals thus written in each line for each field on the liquid-crystal display panel are shown in Table 2 below. Here, $O_n(m)$ indicates data which are sampled at the timing where the signal on the n-th line of the odd-numbered field, of interlacing signals on an m-th frame is matched to the pixel arrangement of the display panel.

TABLE 2

| Pixel line | 1st-field | 2nd-field | 3rd-field | 4th-field |
|---|---|---|---|---|
| 2n−2 line | $E_{n-1}(1)$ | $E_{n-1}(1)$ | $E_{n-1}(2)$ | $E_{n-1}(2)$ |
| 2n−1 line | $O_{n-1}(1)$ | $O_{n-1}(1)$ | $O_{n-1}(2)$ | $O_{n-1}(2)$ |
| 2n line | $E_n(1)$ | $E_n(1)$ | $E_n(2)$ | $E_n(2)$ |
| 2n+1 line | $O_n(1)$ | $O_n(1)$ | $O_n(2)$ | $O_n(2)$ |
| 2n+2 line | $E_{n+1}(1)$ | $E_{n+1}(1)$ | $E_{n+1}(2)$ | $E_{n+1}(2)$ |

FIG. 8 illustrates the constitution of a system where the frame memory is used. In FIG. 8, reference numeral 44 denotes an A-D (analog-to-digital) converter part; 45, the frame memory; and 46, a D-A (digital-to-analog) converter part. In this instance also, signals are written in the same pixel at a cycle of 60 Hz, and a human's eyes can not follow the change in brightness of the picture at this cycle, so that the lowering of image quality caused by flicker does not occur. Also, since the whole picture is rewritten at 60 Hz, the scanning can follow the swift change of the picture.

However, the conventional liquid-crystal display devices described above have the following problems. First, in the case of a liquid-crystal display panel in which the number of vertical scanning signal lines are reduced to half, a low cost can be achieved and the system can be set up with ease, but on the other hand the vertical resolution becomes reduced to half. Image deterioration may occur especially in the display of small characters or letters such as subtitle lettering and in the details of pictures, tending to bring about a problem when displayed on a large screen.

Second, the system of the type making use of the frame memory has no problem on the vertical resolution but requires the A-D converter and the D-A converter, resulting in a large scale of the whole system, and is disadvantageous for making the device compact. Also, since the frame memory itself is expensive, there is the problem of cost increase. Still also, a larger power consumption must be accepted. Moreover, from the viewpoint of image quality, a system employing a digital memory has a restriction on the number of bits, so that there is the problem of limitation on the gradation of the whole display system employing a liquid crystal that can display pictures with a gradation which in principle is infinite in accordance with analog voltage.

Still another method is also known in which as shown in FIG. 9, a sample hold means is formed correspondingly to data signal lines so that the whole picture is rewritten at 60 Hz while holding signals for one line or two lines. In FIG. 9, reference numeral 41 denotes a capacitor for storing the signals; and 42, a control terminal through which the stored image signals are transferred to the data signal lines.

However, when such a memory means is formed inside the liquid-crystal display panel, buffer amplifiers must be provided for the respective data signal lines together with the sample hold means, or correction must be made for the potential drop at the time of signal transfer. When the memory means is formed outside the liquid-crystal display panel, there is the problem that wiring is required correspondingly to the number of lines connecting the sample hold means with the data signal lines. Moreover, since in such parallel output the sample hold means and the data signal lines necessarily correspond in a one-to-one fashion, it has been difficult to realize special reproduced images, e.g., to enlarge or reduce the size of picture in the horizontal direction and to reverse the picture right and left, utilizing such sample hold means.

SUMMARY OF THE INVENTION

To solve the above problems, the present inventors made extensive studies. As the result, they have accomplished the invention described below.

The drive circuit for the color display device of the present invention is a drive circuit for a color display device comprising a plurality of pixels which are wired in matrix through a plurality of data signal lines and a plurality of scanning signal lines, wherein the drive circuit comprises;

an input means for sampling three-primary color image signals for one line which are inputted through three input lines during a given period t, to write the signals in a memory; and an output means for reading the three-primary color image signals from the memory during a certain t/2 period to output the signals to three output lines, and reading the three-primary color image signals from the memory during an additional t/2 period different from the certain t/2 period to output the signals to the three output lines.

In the present drive circuit, the given period t may preferably be one horizontal scanning period. The certain t/2 period and the additional t/2 period may preferably be continuous. The output means may output the three-primary color image signals to the three output lines while changing the combination of three-primary colors during the certain t/2 period and the additional t/2 period, or may output image signals with the same three-primary colors to the three output lines during the certain t/2 period and the additional t/2 period. The drive circuit may enable micro-adjustment of the timing of reading from the memory, matchingly to pixel arrangement of the color display device. Pixels on adjoining two lines connected to the same data wiring of the color display device may have different colors, or may have the same colors. Pixels on adjoining two lines of the color display device may preferably be arranged in shifts of 1.5 pixels. Image signals outputted during the certain t/2 period and the additional t/2 period may be outputted matchingly to the pixels arranged in shifts of 1.5 pixels. The memory may be an analog memory. In the input means, the latter half t/2 period during which the image signals are sampled and written in the memory may be in agreement with the certain t/2 period. The image signals outputted to the output lines may be outputted to the data signal lines in parallel. Image signals on the n-th line of the odd-numbered field may be written in the pixels on 2n line and 2n+1 line, and image signals on the n-th line of the even-numbered field may be written in the pixels on 2n−1 line and 2n line.

The color display device may be any of color display devices comprising a plurality of pixels which are wired in matrix through a plurality of data signal lines and a plurality of scanning signal lines. In particular, an active matrix liquid-crystal display device in which the plurality of pixels each have a switching element is preferable. The switching element may be a thin-film transistor comprising a polycrystalline silicon.

The color display device of the present invention not only enables flicker-free and high-resolution display, but also enables easy achievement of special image reproduction such as enlargement or reduction of images in the lateral direction and right-to-left reversal of images. It also makes it unnecessary to provide sample hold circuits or buffer amplifiers in the respective data signal lines in the color display device, and hence makes it possible to make the color display device compact and improve the yield.

BRIEF DESCRIPTION OF THE DRAWINGS

FIGS. 18A to 18H show timing charts in Embodiment 1 of the present invention.

DESCRIPTION OF THE PREFERRED EMBODIMENTS

Embodiments of the present invention will be described below in detail.

Figure 2:
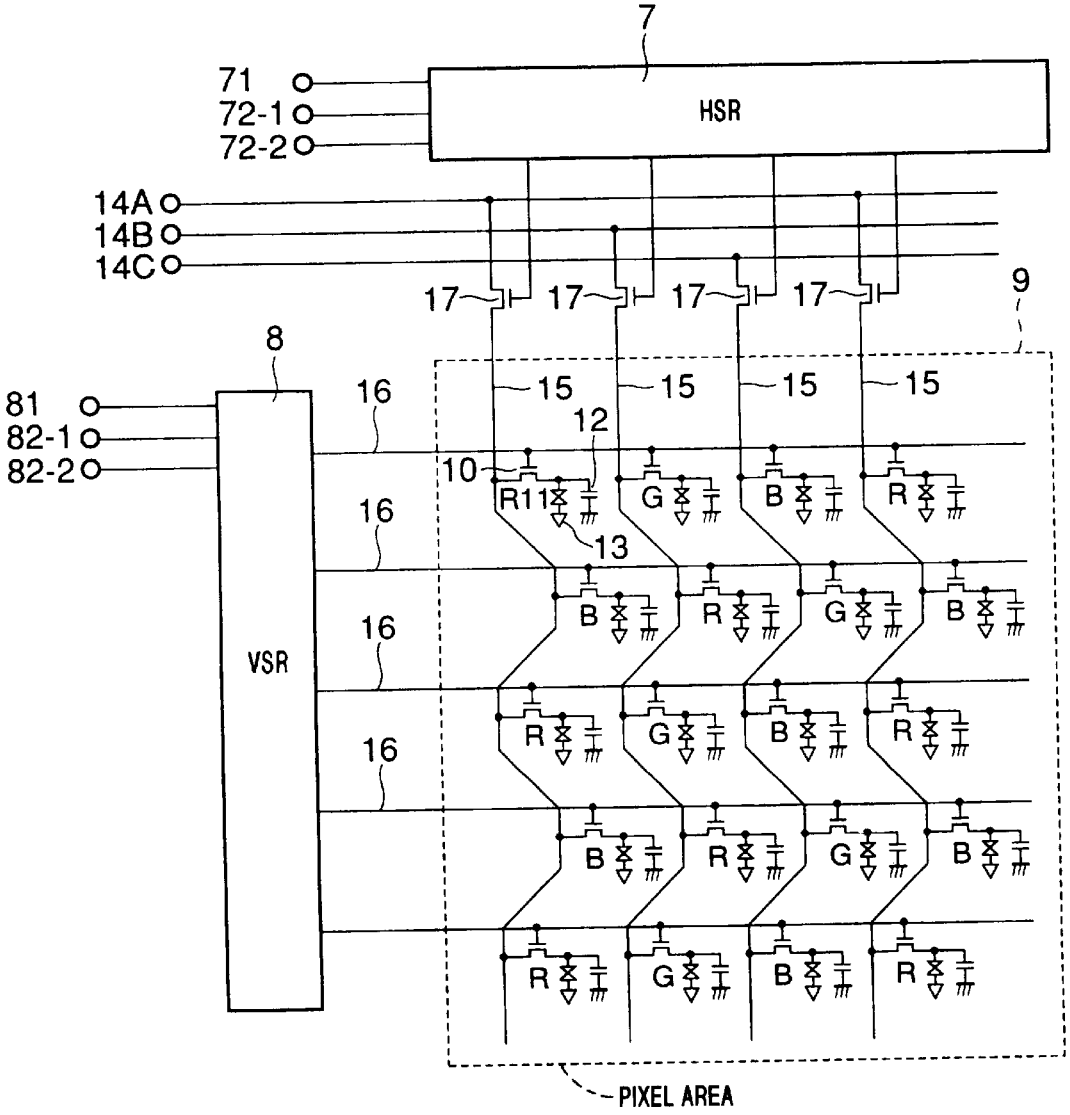
FIG. 2 illustrates the constitution of a circuit in the display part of the liquid-crystal display device according to an embodiment of the present invention.
Figure 3:
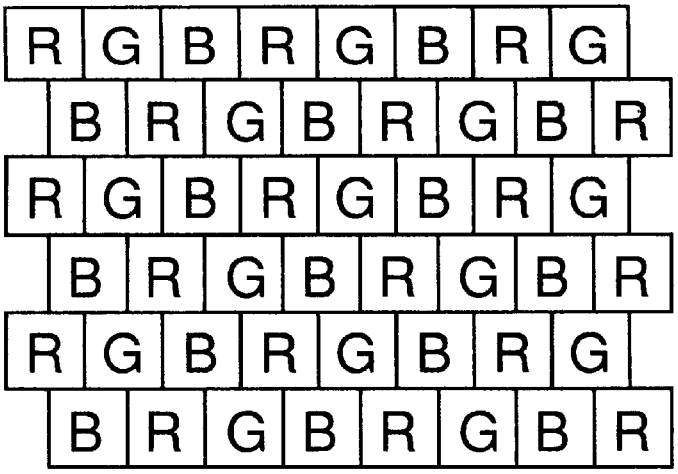
FIG. 3 illustrates color arrangement of pixels on a liquid-crystal display panel used in an embodiment of the present invention.

FIG. 3 illustrates the color arrangement of pixels on a liquid-crystal display panel used in first and second embodiments of the present invention. Here, the display part of the liquid-crystal display panel has the circuit construction as shown in FIG. 2, which will be detailed later, and the pixels are arranged in a mosaic type delta arrangement. Hence, pixels with different colors are connected to information signal lines 15 shown in FIG. 2. Pixels of the same color are arranged at the positions shifted by a half period (1.5 pixels) in the horizontal direction for each even-numbered line and odd-numbered line, and hence images signals of the respective colors are sampled at the timing made different for each even-numbered line and odd-numbered line.

Embodiment 1

Figure 1:
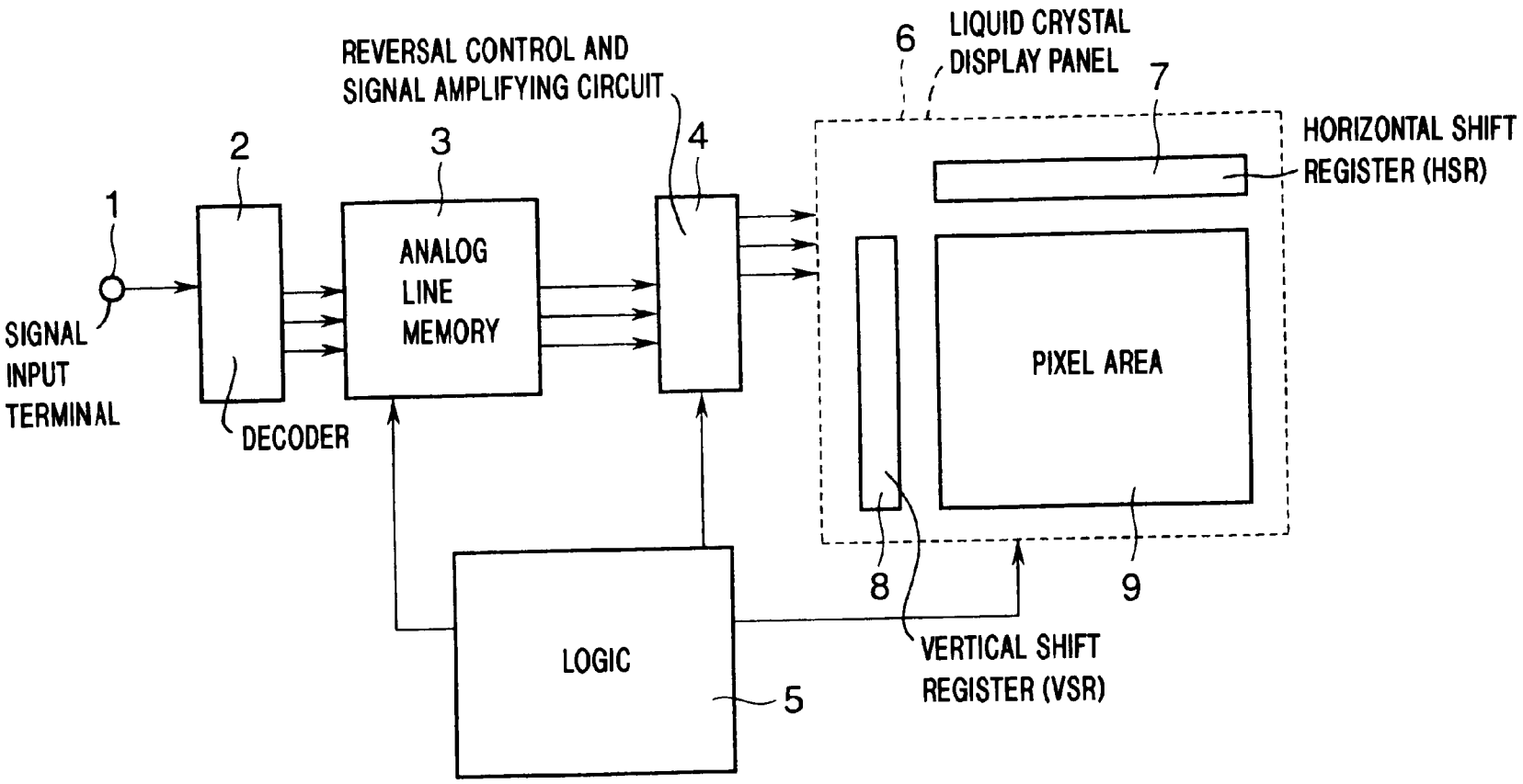
FIG. 1 illustrates the constitution of a system of a liquid-crystal display device according to an embodiment of the present invention.
Figure 7:
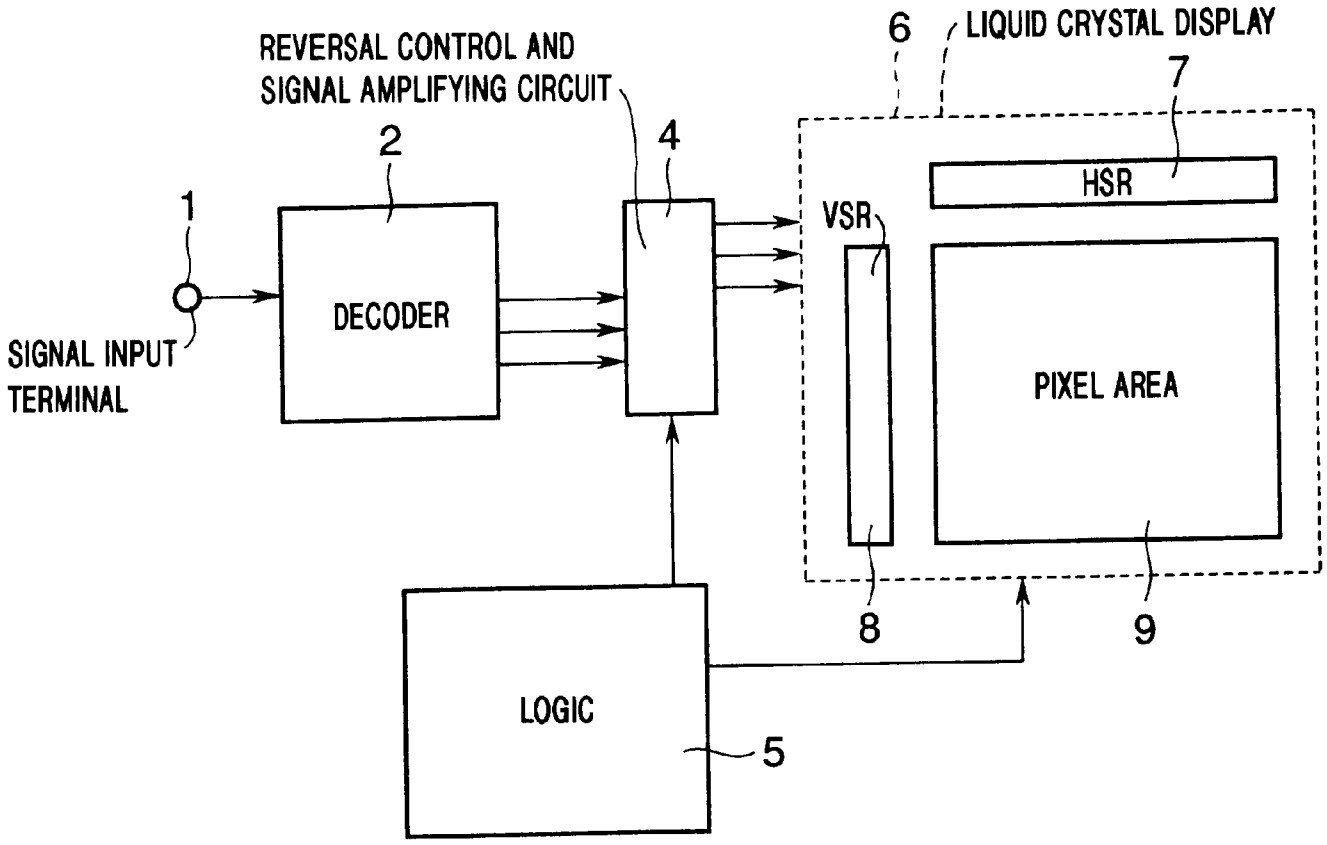
FIG.7 PRIOR ART
FIG. 7 illustrates the constitution of a system of liquid-crystal display devices conventionally used.
Figure 8:
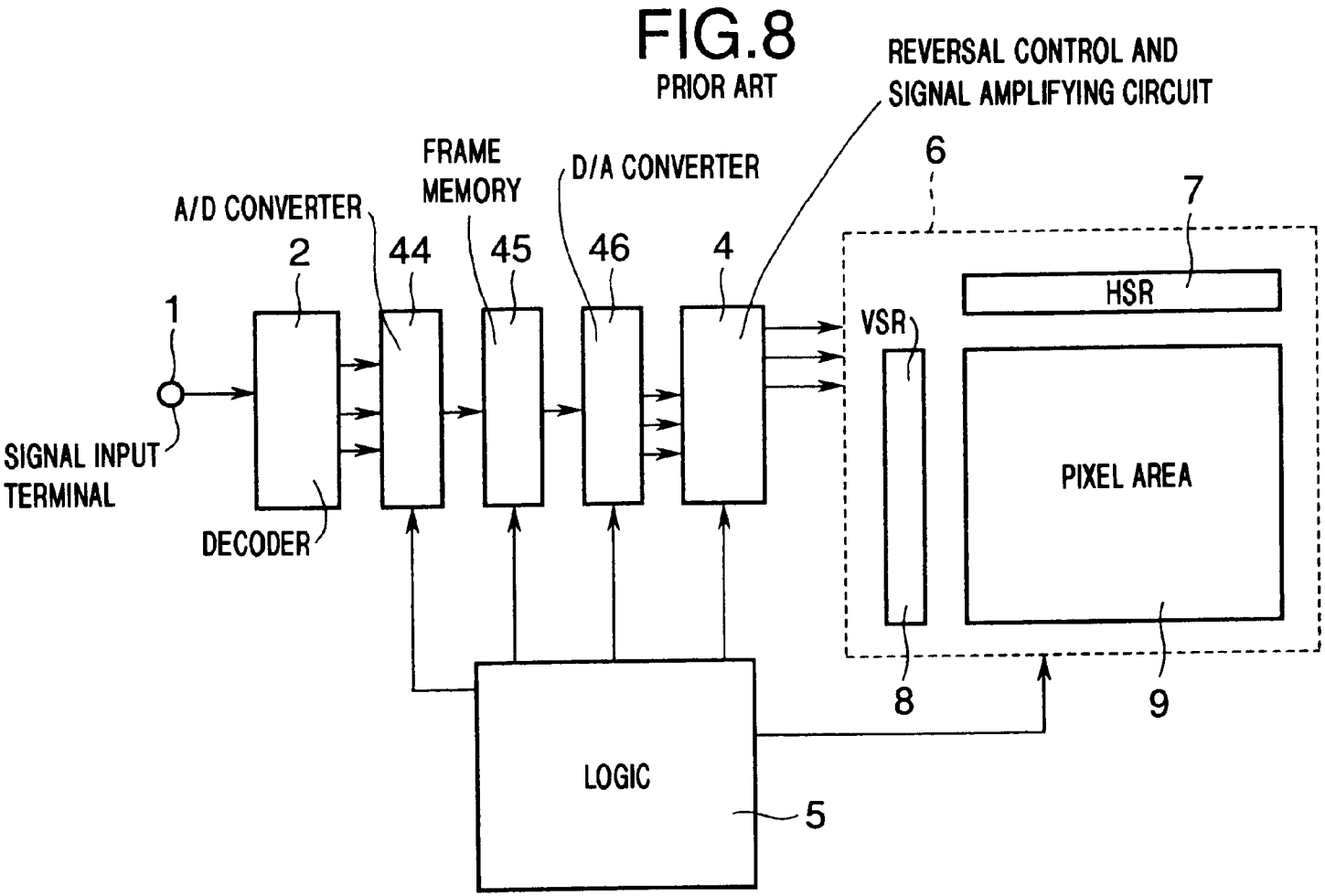
FIG.8 PRIOR ART
FIG. 8 illustrates the constitution of a system of conventional liquid-crystal display devices where a frame memory is used.
Figure 9:
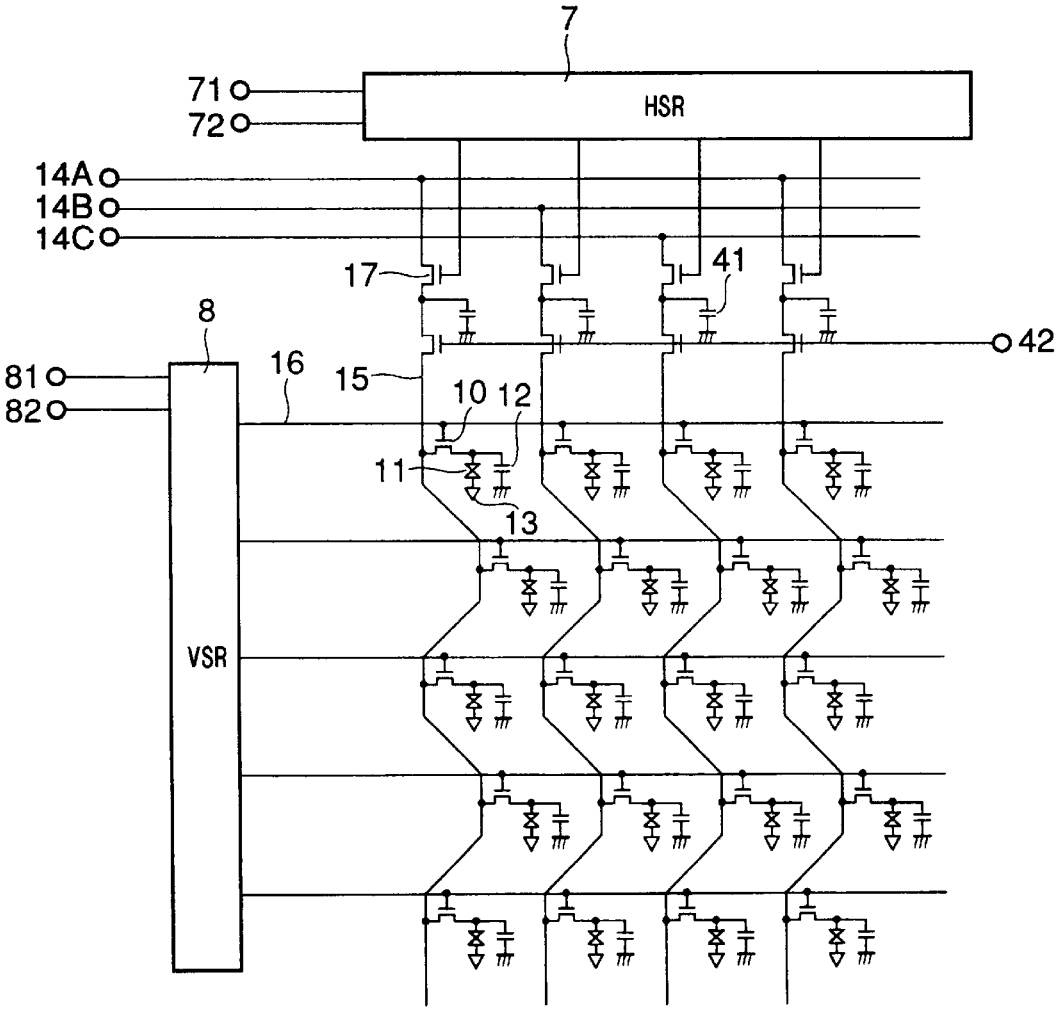
FIG.9 PRIOR ART
FIG. 9 illustrates the constitution of a circuit in the display part of a conventional liquid-crystal display device.

FIG. 1 illustrates the constitution of a system of a liquid-crystal display device employing line memories that carry out serial input/output by the use of two systems of shift registers. The device basically has the same constitution as the conventional display device shown in FIG. 7. In FIG. 1, like members are denoted by like reference numerals as those in FIG. 7. In FIG. 1, reference numeral 3 denotes an analog line memory part. Interlacing signals inputted to the signal input terminal 1 are color-decoded in the decoder 2, and thereafter successively converted into scanning signals through the line memory part 3, where the information for the whole picture of the liquid-crystal display panel 6 is rewritten at a cycle of 60 Hz. In this embodiment, signal information is written matchingly to the spatial arrangement of the R, G, B pixels. It is also possible in the decoder part 2 to delay R, G, B signals in respectively different amounts, matchingly to the order of arrangement of the R, G, B pixels. In such an instance, signal information matched to the spatial arrangement of pixels on the liquid crystal can be obtained using the same sampling pulse, so that the frequency in sampling blocks of the memory part and liquid-crystal display panel can be made to be ⅓.

FIG. 2 illustrates the constitution of a circuit at the display part of the above liquid-crystal display panel. In FIG. 2, reference numeral 7 denotes the HSR; 8, the VSR; and 9, the pixel area. Reference numeral 10 denotes a thin-film transistor; 11, a liquid-crystal; 12, a hold capacitance; 13, an opposing electrode; 14 (14A to 14C), video signal input lines; 15, data signal lines; 16, scanning signal lines; and 17, signal line selection switches. Reference numeral 71 denotes an HSR start pulse (HST); 72-1 and 72-2, HSR two-phase clock pulses (H1, H2); 81, a VSR start pulse (VST); and 82-1 and 82-2, VSR clock pulses (V1, V2).

Figure 4:
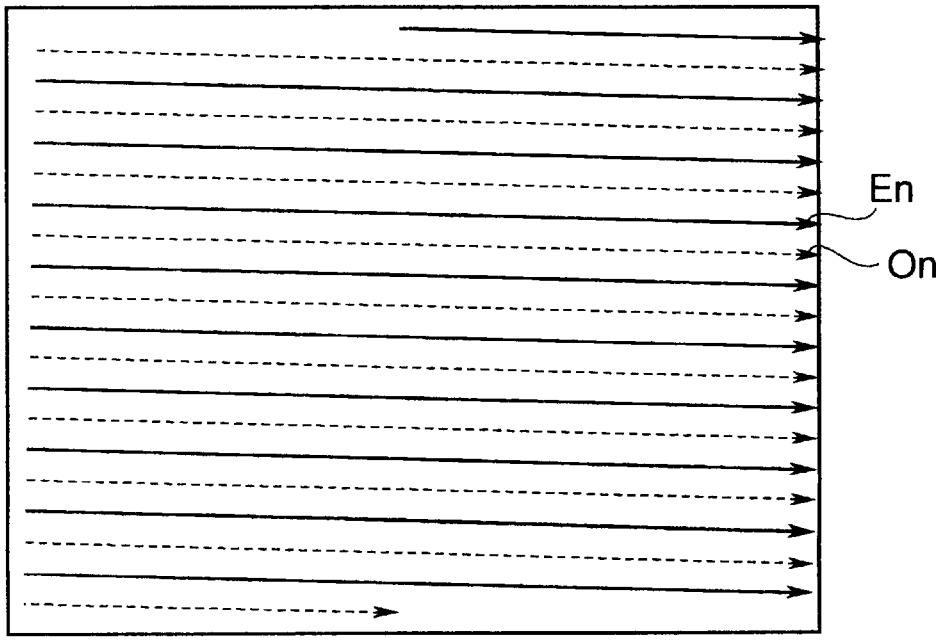
FIG. 4 diagrammatically illustrates interlacing signal scanning lines to be displayed by the liquid-crystal display device of the present invention.

FIG. 4 diagrammatically illustrates interlacing signal scanning lines to be displayed by the liquid-crystal display device. In FIG. 4, letter symbol $O_n$ denotes an n-th line in the odd-numbered field; and $E_n$, an n-th line in the even-numbered field. In such interlaced scanning, the odd-numbered lines are scanned in such a form that the scanning is carried out on every other line, which is drawn by the dashed lines, as in the odd-numbered field, and the other lines are filled up as in the even-numbered field, to complete a single picture (one frame) at 30 Hz.

In case of image singles of NTSC method, the vertical retrace line interval is used in order to discriminate between the odd-numbered field and the even-numbered field. The difference between the odd-numbered field and the even-numbered field during the vertical interval is illustrated by a time chart of FIGS. 21A and 21B regarding the vertical interval in NTSC method. In the figure, $T_1$ denotes the vertical retrace line interval; $T_2$ denotes the vertical synchronization pulse interval; $T_3$ denotes 9 horizontal scanning intervals containing the equalizing pulse intervals. One H means one horizontal scanning interval. A1 and A2 denote the initial position of each field. T4 denotes effective signal intervals.

Figures 21A, 21B:
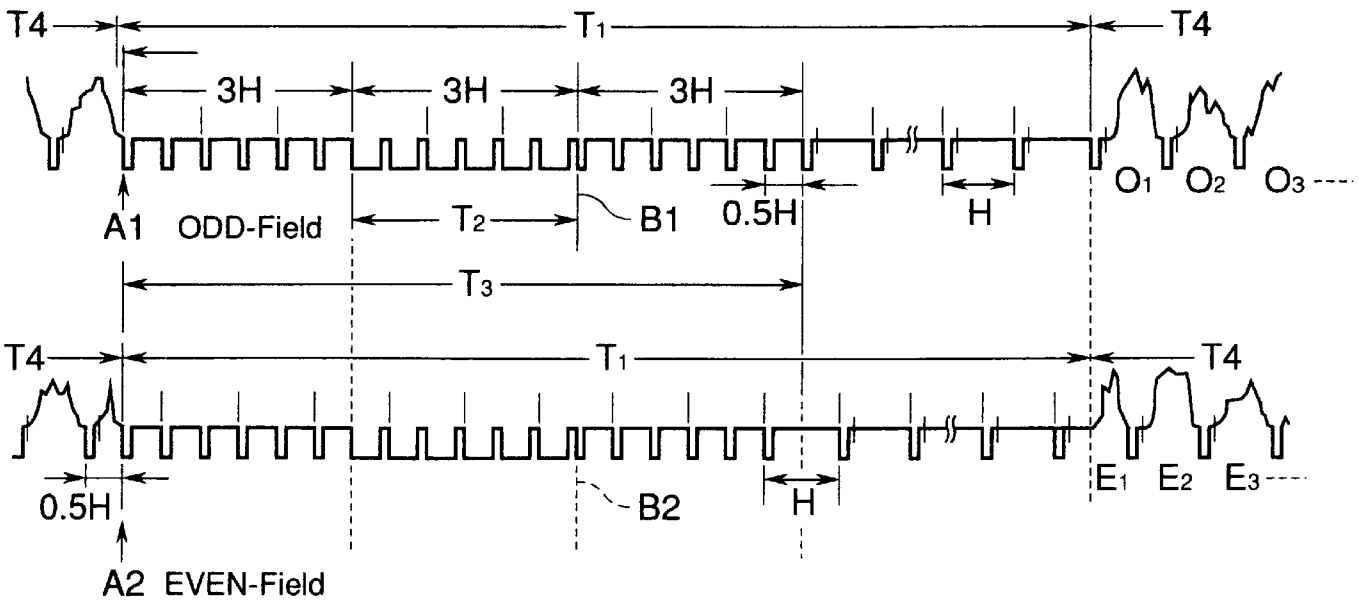
FIGS. 21A and 21B are time charts regarding the vertical interval in NTSC method.

A field wherein the initial point (or terminal point) of one horizontal scanning interval (H) coincides with the terminal point of the vertical synchronization pulse interval ($T_2$) as shown in FIG. 21A is defined as Odd-field. A field wherein a middle point of one horizontal scanning interval (H) coincides with terminal point B2 of the vertical synchronization pulse interval, as shown in FIG. 21B, is defined as Even-field. In these cases, $O_1$, $O_2$, $O_3$, . . . , $O_n$ are the first, second, third, . . . , n-th line of the odd-field, respectively; and $E_1$, $E_2$, $E_3$, . . . , $E_n$ are the first, second, third, . . . , n-th line of the even-field, respectively.

Figure 5:
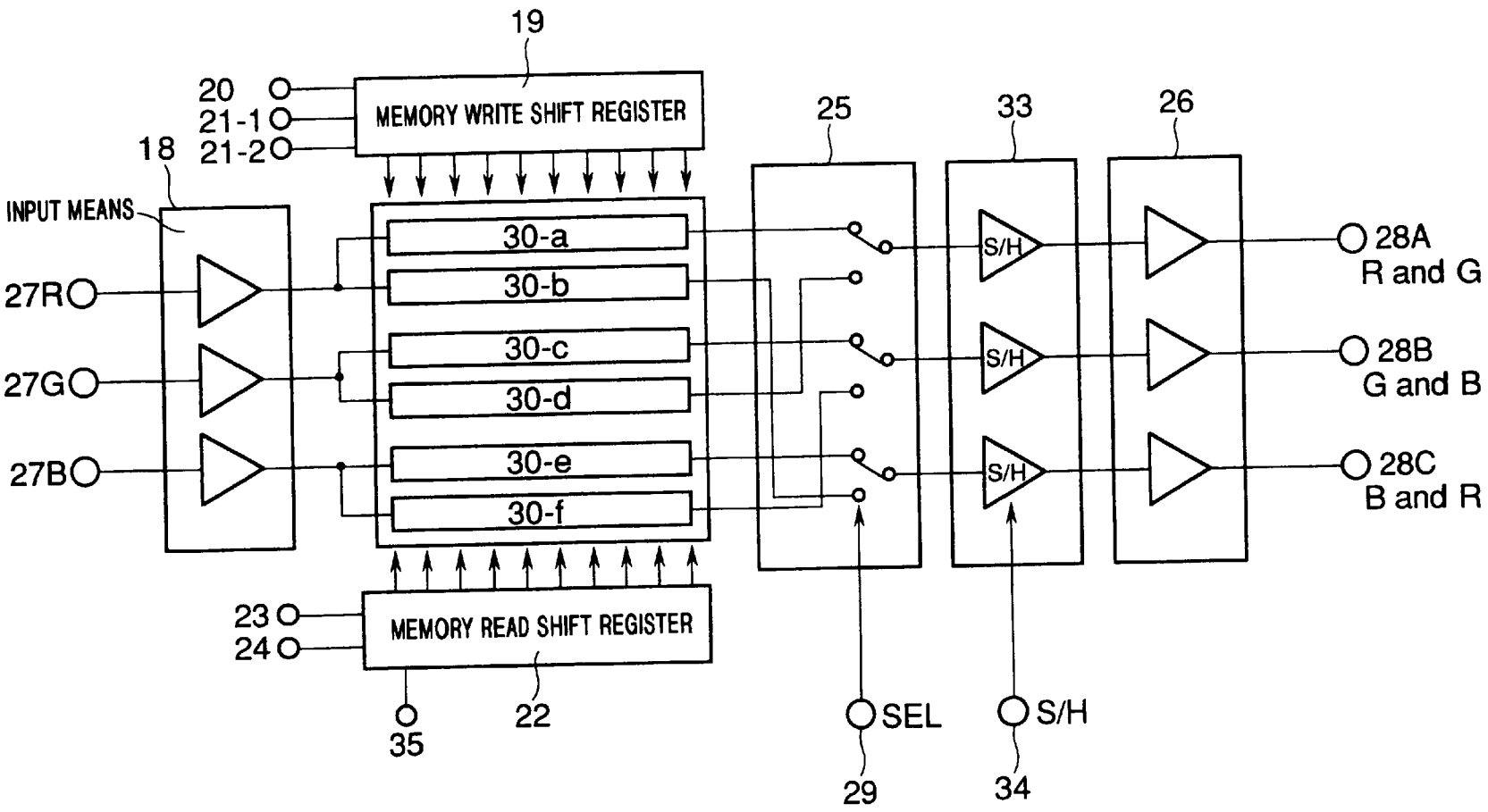
FIG. 5 is a block diagram of an analog line memory part of the liquid-crystal display device shown in FIG. 1.
Figure 10:
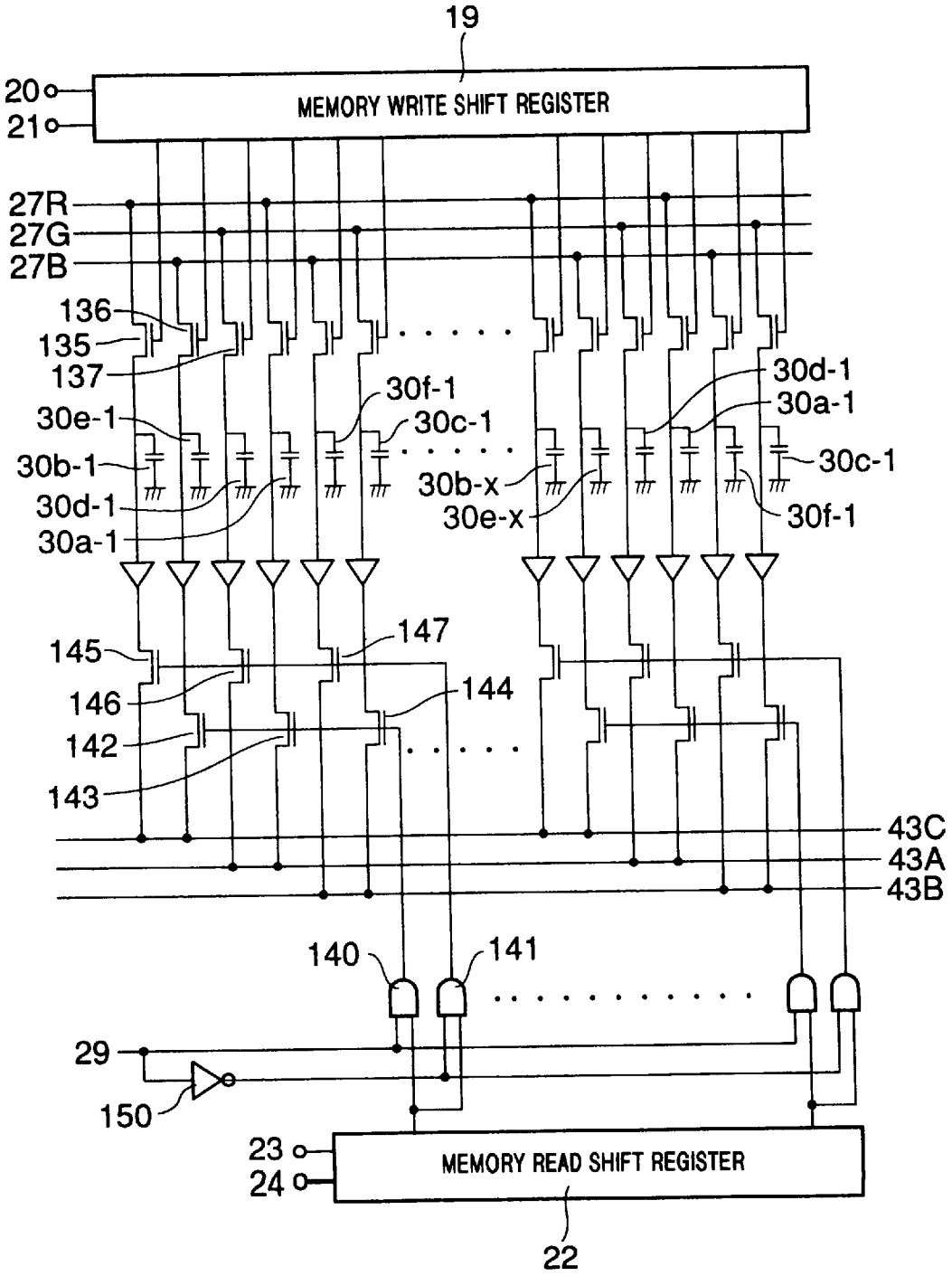
FIG. 10 illustrates a specific example of the constitution of an analog line memory part in Embodiment 1 of the present invention.

FIG. 5 shows a block diagram of the above analog line memory part in the present embodiment. In FIG. 5, reference numeral 18 denotes an input means of the memory part; 19, a shift register for memory writing (WSR); 20, a start pulse for the WSR (WST); 21-1 and 21-2, clock pulses for the WSR (WCLK1, WCLK2); 22, a shift register for memory reading (RSR); 23, a start pulse for the RSR (RST); and 24, a clock pulse for the RSR (RCLK). Reference numeral 25 denotes a switching control part for switching the signals sent to video lines, matchingly to the color arrangement on the liquid-crystal display panel. Reference numeral 33 denotes a sample hold circuit; and 34, an input terminal through which sample hold pulses are fed. Reference numeral 26 denotes an output means of the memory part. Reference numerals 27R, 27G and 27B denote input terminals of R, G and B signals, respectively; 28A, 28B and 28C, output terminals for outputting the signals switched by the switching control part 25 for each even-numbered line and odd-numbered line of the liquid-crystal screen in which R and G, G and B, and B and R, respectively, are written; and 29, an input terminal for switching control signals. Reference numeral 35 denotes a control terminal for micro-adjusting the timing of reading from the memory, the role played by which will be described later. Reference numerals 30*a* to 30*f* denote line memories for the even-numbered lines and odd-numbered lines of the respective R, G, B colors on the liquid-crystal screen, and are allocated from the same horizontal signal in an alternate fashion at intervals of one clock pulse of the writing shift register. A specific example of how this part is constituted is shown in FIG. 10. In FIG. 10, reference numerals 43A, 43B and 43C denote memory output lines between the switching control part 25 and sample hold circuit 33 shown in FIG. 5. Numerals and letter symbols 1 to x of the line memories 30*a* to 30*f* indicate 1 bit to x bits of the respective line memories. When signals are read, lines 30*a*, 30*c* and 30*e* or lines 30*b*, 30*d* and 30*f* are selected in accordance with the switching control signals fed through the input terminal 29.

FIG. 10 also illustrates in detail how the circuit of the line memory part shown in FIG. 5 is set up. In FIG. 10, reference numerals 27R, 27G and 27B denote input image signals; 19, the shift register for memory writing (WSR); 22, the shift register for memory reading (RSR); and 43A, 43B and 43C denote the memory output lines of the image signal data.

The input image signals 27R, 27G and 27B, having been subjected to gamma correction suited for liquid-crystal display in the decoder at the former stage of the circuit shown in FIG. 10 and subjected to intermediate amplification matched to dynamic ranges of the line memories, are sampled by the shift register 19, having 2×600 steps, and are written in the line memories 30 through transistors 135, 136, 137 and so on. During one horizontal scanning period, this sampling is performed 1,200 times, which correspond to twice the number of horizontal pixels of the liquid-crystal display panel. The sampling is performed in the order of R, G, B matchingly to the color arrangement on the liquid-crystal display panel so that the signals are written in the line memories 30 in the order of $R_{a1}$, $G_{b1}$, $B_{a1}$, $R_{b1}$, $G_{a1}$, $B_{b1}$, . . . (those represented by $R_{ax}$, $G_{ax}$ and $B_{ax}$ indicate data corresponding to the xth bit data in the even-numbered lines of the liquid-crystal display panel, and those represented by $R_{bx}$, $G_{bx}$ and $B_{bx}$ indicate data corresponding to the xth bit data in the odd-numbered lines of the liquid-crystal display panel).

Meanwhile, the reading of data from the line memories 30 is performed in the manner grouped into data $R_{a1}$, $G_{a1}$, $B_{a1}$, $R_{a2}$, $G_{a2}$, $B_{a2}$, . . . $R_{a200}$, $G_{a200}$, $B_{a200}$ corresponding to the even-numbered lines of the liquid-crystal display panel and data $R_{b1}$, $G_{b1}$, $B_{b1}$, $R_{b2}$, $G_{b2}$, $B_{b2}$, . . . $R_{b200}$, $G_{b200}$, $B_{b200}$ corresponding to the odd-numbered lines of the liquid-crystal display panel, and the both data are transferred to the liquid-crystal display panel 6 during one horizontal scanning period. At the time of the sampling, phases respectively deviate between $R_{ax}$, $G_{ax}$ and $B_{ax}$, and between $R_{bx}$, $G_{bx}$ and $B_{bx}$, correspondingly to one pixel of the liquid-crystal display panel 6, and hence the reading from the line memories 30 and the writing in the liquid-crystal display panel 6 are simultaneously performed on the above three kinds of pixels. More specifically, when the first-line data are transferred to the liquid-crystal display panel 6, the ODD signal applied to the input terminal 29 turns "H", the first-step output of the shift register 22 turns "H" and an AND gate turns "H", so that transistors 142 to 144 are electrically connected and the data $R_{a1}$, $G_{a1}$ and $B_{a1}$ are simultaneously outputted to the output signal lines 43, 43B and 43C.

Similarly, when the second-line data are transferred to the liquid-crystal display panel, the ODD signal applied to the input terminal 29 is "L", and turns "H" by the aid of an inverter 150, and hence the AND gate turns "H", so that transistors 145 to 147 are electrically connected and the data $R_{b1}$, $G_{b1}$ and $B_{b1}$ are simultaneously outputted to the output signal lines 43A, 43B and 43C.

Writing in and reading from the line memories 30 are performed in the order shown below.

First, by the start pulse (signal) 20, the shift register 19 is started to operate, and the sampling is performed 1,200 times during one horizontal scanning period, and the data are successively written in the line memories 30. At the time the sampling performed 600 plus 6 times or more has been completed, the shift register 22 is started to operate, by the start pulse 23 of the reading side shift register 22, so that the data at the odd-numbered address are read out three by three in the order of address 1, 3 and 5 ($R_{a1}$, $G_{a1}$, $B_{a1}$) and address 7, 9 and 11 ($R_{a2}$, $G_{a2}$, $B_{a2}$) of the line memories 30.

When the cycle of reading clock pulses at this reading is set three times that of writing clock pulses, the reading is completed up to address 1200 minus 6 at the time the writing in the line memories 30 has been completed, and hence the reading is by no means performed before the writing in the line memories 30. Also, the reading is performed within a period of t/2 which is a half of the horizontal scanning period t, and the writing in the first line of the liquid-crystal display panel is completed.

During the next t/2 period, the data at the even-numbered address are successively read out three by three in the order of address 2, 4 and 6 ($B_{b1}$, $R_{b1}$, $G_{b1}$) and address 8, 10 and 12 ($B_{b2}$, $R_{b2}$, $G_{b2}$) of the line memories 30.

At this stage, the sampling of image signals during the next horizontal scanning period is performed, and the data are written in the line memories 30. So long as the reading is ahead of the writing, the order of writing and reading is by no means reversed.

When the data are read out after the writing in the line memories 30 has been completed, line memories corresponding to image signals during two horizontal scanning periods are required. However, the line memories can be reduced to half when the image signal data are made to be read from the same line memory while the data are written in the line memory as in the present embodiment.

The timing of the above operation is shown in FIGS. 18A to 18H. The data read out are converted into alternating-current signals through the reversal control and signal amplifying part shown in FIG. 1, and then inputted to the liquid-crystal display panel 6.

The horizontal shift register 7 of this liquid-crystal display panel 6 is driven at the same number of steps and the same timing as those of the shift register (22 in FIG. 10) of the line memory part 3. In the vertical shift register 8, having 480 steps, the data are shifted taking precedence of the start signal of reading of the line memory part 3.

The above operation is repeated for 240 horizontal scanning periods, whereby image signal data can be written in 480 horizontal pixel lines of the liquid-crystal display panel in one field.

The image signal data to be written in the first field and the second field during the horizontal scanning periods may be written in the same horizontal pixel lines of the liquid-crystal display panel, or in the lines shifted one by one. In the case when written in the lines shifted one by one, the vertical resolution can be improved.

Figures 6A, 6B, 6C, 6D, 6E, 6F, 6G, 6H, 6I, 6J, 6K, 6L, 6M, 6N, 6O:
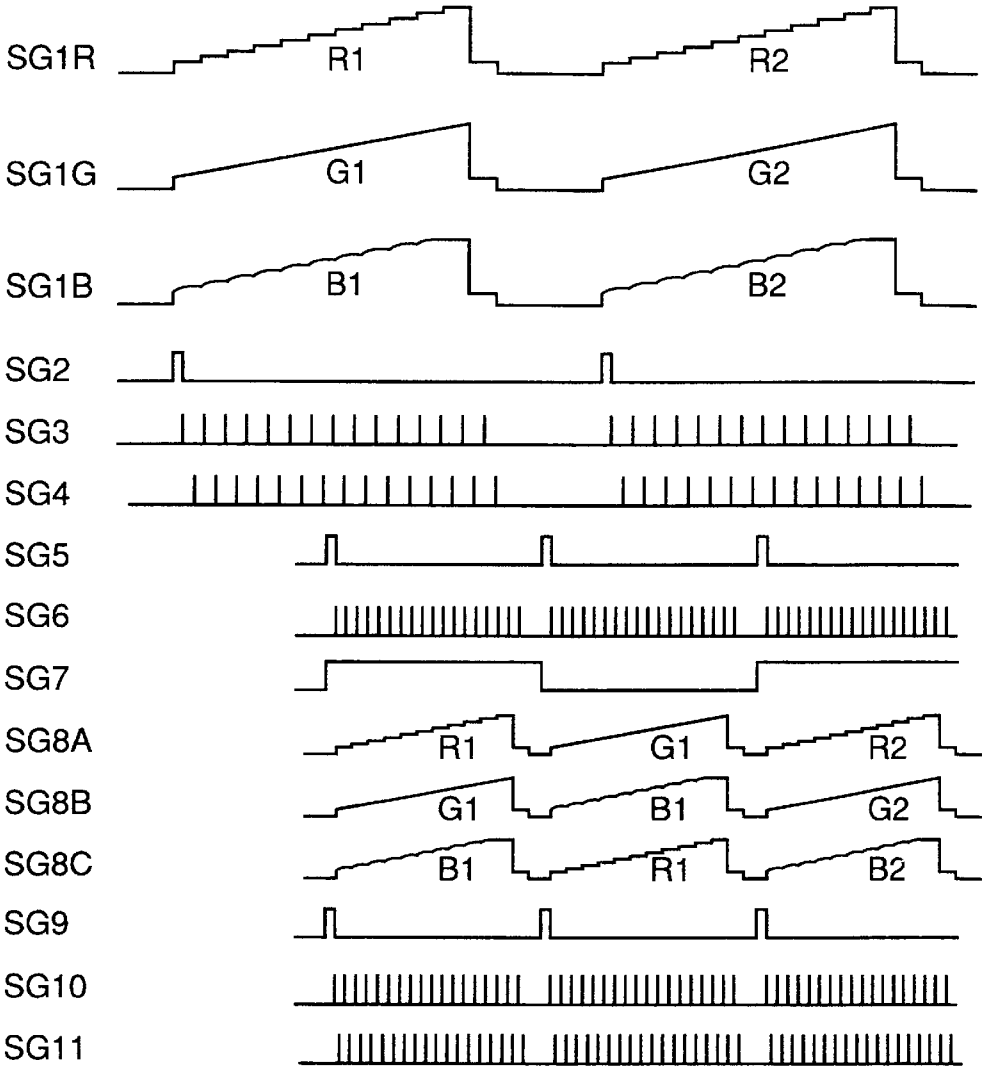
FIGS. 6A to 6O illustrate the drive timings of liquid crystal and memory during the horizontal scanning period in Embodiment 1 of the present invention.

FIGS. 6A to 6O illustrate in detail the drive timing of liquid crystals and memory during the horizontal scanning period. In FIGS. 6A to 6O, FIG. 6A (SG1R) represents a red image signal; FIG. 6B (SG1G), a green image signal; FIG. 6C (SG1B), a blue image signal; FIG. 6D (SG2), the WST; FIG. 6E (SG3), the WCLK1; FIG. 6F (SG4), the WCLK2; FIG. 6G (SG5), the RST; FIG. 6H (SG6), the RCLK; FIG. 6I (SG7), a color selection switching signal; FIG. 6J (SG8A) to FIG. 6L (SG8C), signals converted into line-consecutive scanning signals outputted from the memory part; FIG. 6M (SG9), the HST; FIG. 6N (SG10), the H1; and FIG. 6O (SG11), the H2.

Under such constitution, serial signals sampled in double density are taken out at intervals of one line. The signals are changed into two serial signals rearranged in their order so as to be matched to the pixel arrangement of a liquid-crystal screen, and thereafter continuously outputted while being switched to the respective output terminals, during one horizontal scanning period by means of the reading shift register operated by another clock pulse. Thus, the scanning is performed.

The signals written in each line (2n to 2n+4) for each field on the liquid-crystal display panel in the present embodiment are shown in Table 3 below. Here, $O_n(m)$ and $O_n'(m)$ indicate data which are sampled at each different timing where the signal on the n-th line of the odd-numbered lines, of interlacing signals on an m-th frame is matched to the pixel arrangement on the even-numbered lines or odd-numbered lines of the display panel.

TABLE 3

| Pixel line | 1st-field | 2nd-field | 3rd-field | 4th-field |
|---|---|---|---|---|
| 2n line | $O_{n-1}(1)$ | $E_n(1)$ | $O_{n-1}(2)$ | $E_n(2)$ |
| 2n+1 line | $O_n'(1)$ | $E_n'(1)$ | $O_n'(2)$ | $E_n'(2)$ |
| 2n+2 line | $O_n(1)$ | $E_{n+1}(1)$ | $O_n(2)$ | $E_{+1}(2)$ |
| 2n+3 line | $O_{n+1}'(1)$ | $E_{n+1}'(1)$ | $O_{n+1}'(2)$ | $E_{n+1}'(2)$ |
| 2n+4 line | $O_{n+1}(1)$ | $E_{n+2}(1)$ | $O_{n+1}(2)$ | $E_{n+2}(2)$ |

The even-numbered lines and odd-numbered lines of the picture are rewritten for each field (60 Hz), and hence the problems on dynamic resolution and flicker can also be settled. When viewed as one field, the resolution in the vertical direction is half the resolution attained by the original signals, but the vertical resolution is quasi enhanced by shifting the lines one by one to make display.

In this way, the interlacing signals are converted into line-consecutive scanning signals in low-cost line memories and a good image quality is achieved.

Incidentally, in this embodiment, serial signals sampled in double density are changed into two serial signals rearranged in their order so as to be matched to the pixel arrangement of a liquid-crystal screen. However, the interlacing signals can be converted into line-consecutive scanning signals in low-cost line memories and a good image quality can be achieved also when the signals sampled are not rearranged in their order, depending on the relationship between pixel arrangement and memory arrangement, as in the case of in-line type pixel arrangement where the color arrangement in the even-numbered lines is in the same order as that in the odd-numbered lines.

Figures 11A, 11B, 11C, 11D, 11E:
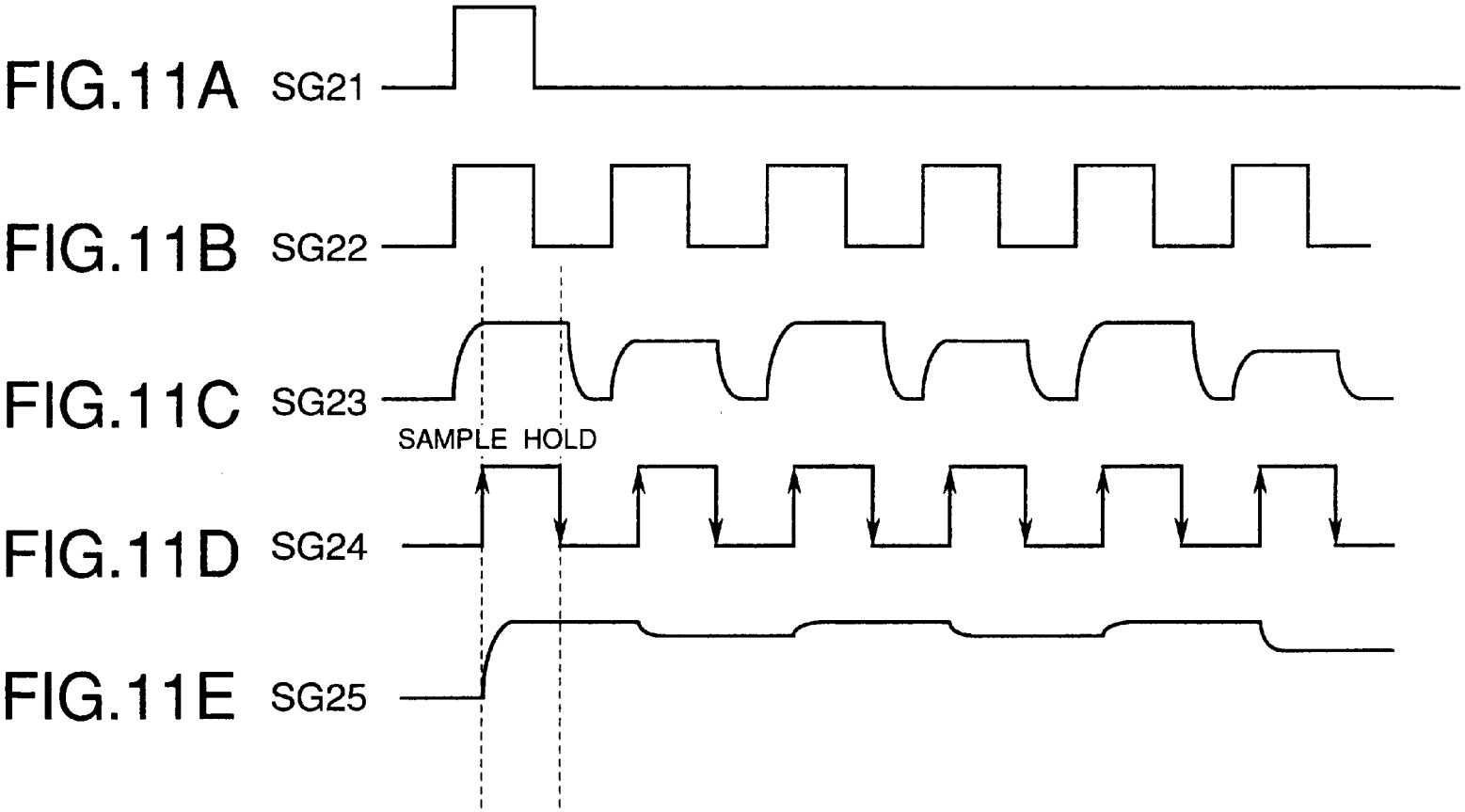
FIGS. 11A to 11E illustrate the respective signals of the memory part shown in FIG. 5.

Now, in order to describe the role played by the switch (control terminal) 35 for micro-adjusting the timing of reading from the memory, the memory output signals and the signals written in the pixels on the liquid-crystal display panel will be considered. FIGS. 11A to 11E illustrate the respective signals of the memory part shown in FIG. 5. FIG. 11A represents a read start pulse; and FIG. 11B, a read clock pulse. FIG. 11C represents a memory output before sample holding. FIG. 11D represents a sample hold pulse, which samples FIG. 11C at the rise and holds it at the decay. FIG. 11E represents an output signal after the sample holding.

Figures 12A, 12B, 12C, 12D, 12E, 12F, 12G, 12H, 12I:
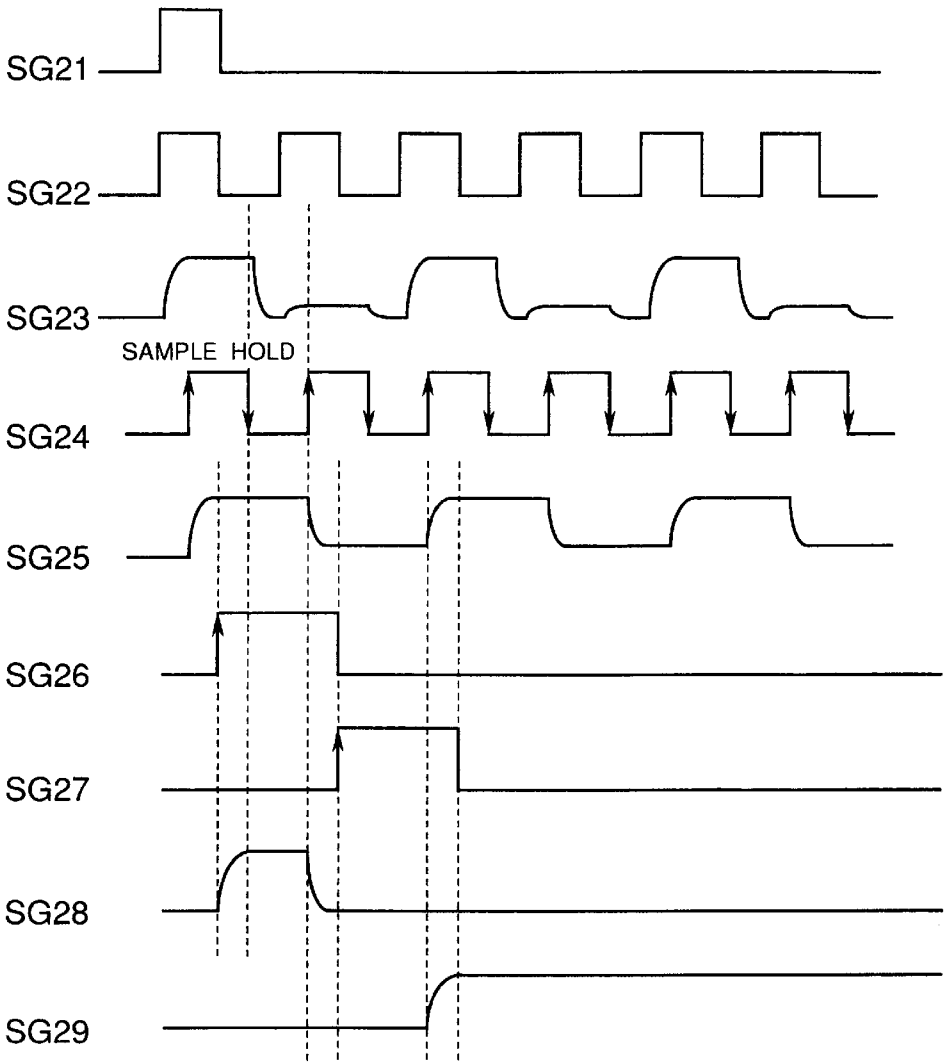
FIGS. 12A to 12I illustrate the timings of the charging of liquid crystal and hold capacitance in the case when no phase control is made, according to Embodiment 1 of the present invention.

The signals thus read from the memories are inputted to video signal input terminals 14A, 14B and 14C of the liquid-crystal display panel as shown in FIG. 2, through reversal control amplifiers, where voltages are successively applied by the horizontal shift register 7 to the gates of transistors 17 for selecting information signal lines, whereby the liquid crystal and hold capacitance of the pixels selected by thin-film transistors 10 are successively charged. How they are charged in that course is shown in FIGS. 12A to 12I. FIG. 12F and FIG. 12G represent gate voltages of the transistors 17 for selecting information signal lines, and FIG. 12H and FIG. 12I represent changes in potential of the liquid crystal and hold capacitance of the adjoining pixels selected by the corresponding thin-film transistors 10.

Figure 13:
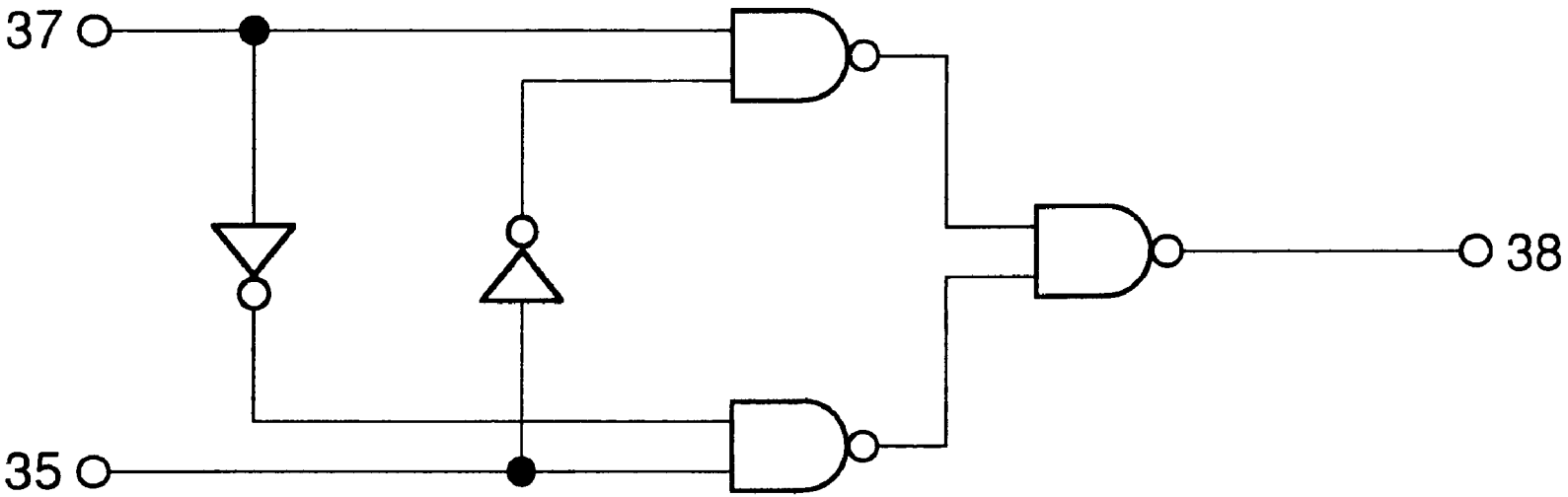
FIG. 13 illustrates the constitution of a circuit in the case when memory reading clock pulses are deviated by a half phase with respect to start pulses, as used in Embodiment 1 of the present invention.
Figure 14:
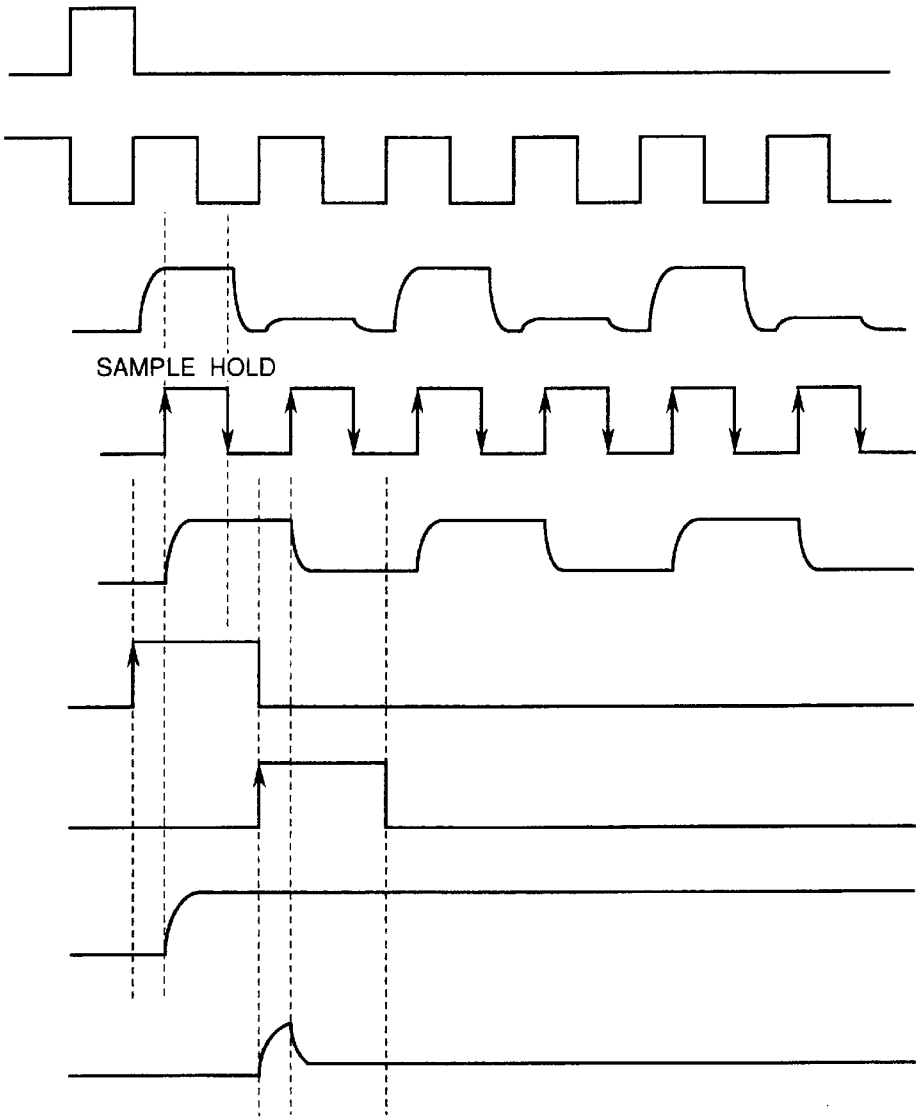
FIGS. 14A to 14I illustrate the timings of the charging potentials for liquid crystal and pixels in the case when the constitution shown in FIG. 3 is employed.

As is clear from FIGS. 12A to 12I, the respective bit outputs of FIG. 12E from the memories and the information signal line selecting signals of FIG. 12F and FIG. 12G have phases not matched to each other, so that the selection period extends over the next bit. Hence, the charging potential of pixels, though having charged original bits, may consequently have a potential determined by the next bit at the last of the selection period. As the result, the original signals are not displayed on the liquid-crystal display panel. Especially when like memories are intended to be utilized for those having different selection pulse delay time and signal delay time as in some liquid-crystal display panels, it is necessary to control memory outputs to an optimum phase relationship. In this embodiment, using as an example the circuit as shown in FIG. 13, the memory output clock pulse is deviated by a half phase with respect to the memory read start pulse in accordance with the switch control of the switch 35. Memory read clock pulse (RCLK) inputted from a terminal 24 is inputted to a terminal 37, and phase-controlled memory read clock pulse is outputted from a terminal 38. The respective signals and the charging potential of pixels obtained here are shown in FIGS. 14A to 14I. Since the memory output clock pulse has been deviated by a half phase with respect to the start pulse, each bit output of FIG. 14E from the memory and the phase of the information signal line selecting signals of FIG. 14F and FIG. 14G are matched to each other, so that the original signals are charged in liquid-crystal pixels. Of course, the micro-adjusting terminal 35 may be formed in multiple bits, whereby it becomes possible to deal with more delicate phase control, leading to an expansion of the utilization of memories and an improvement in image quality.

Embodiment 2

Figure 15:
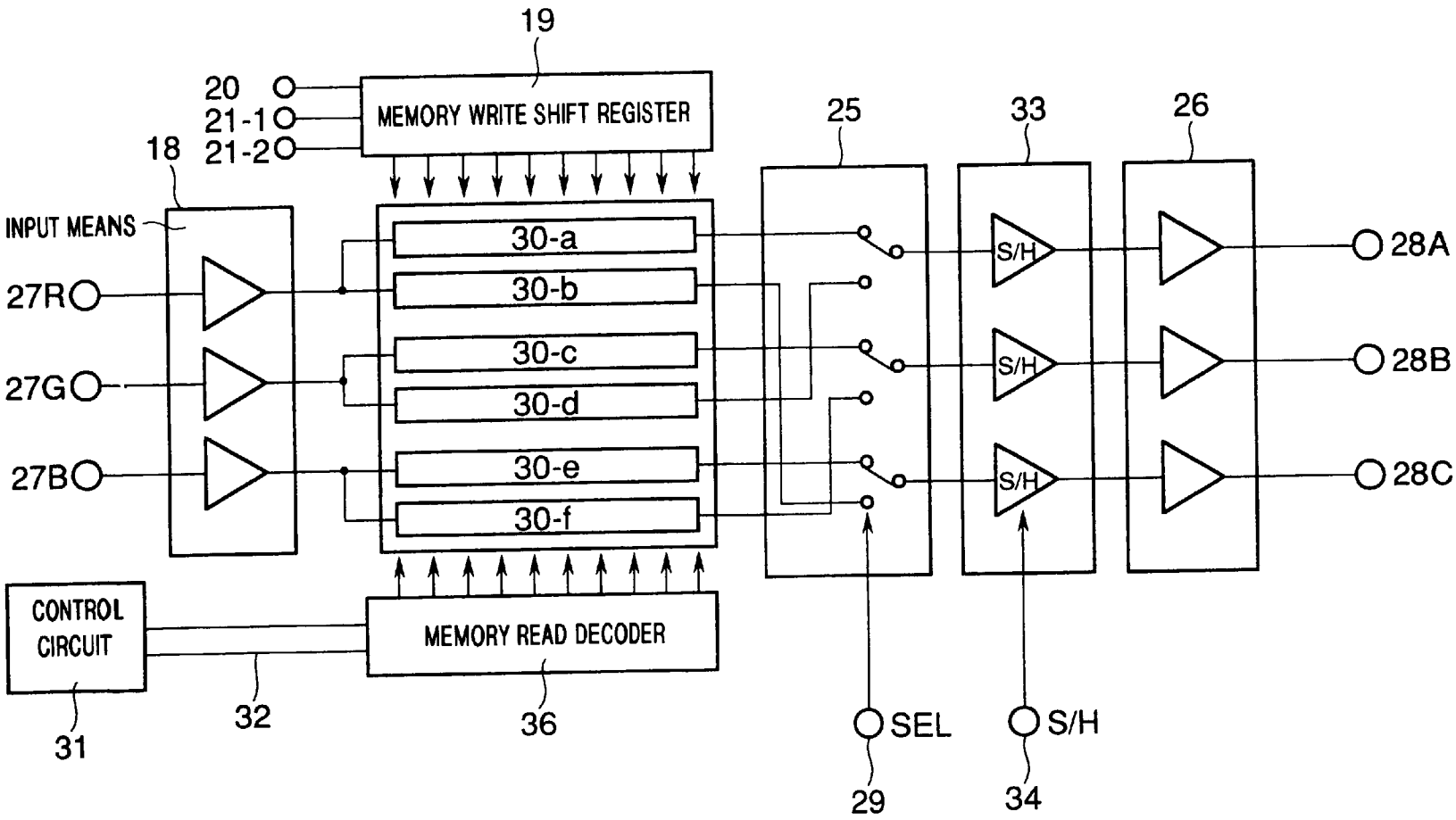
FIG. 15 is a block diagram of an analog line memory part in Embodiment 2 of the present invention.

As Embodiment 2 of the present invention, FIG. 15 shows a block diagram of an analog line memory part that carries out serial input/output, provided with a shift register for writing and an X-direction scanning decoder for reading. The whole system thereof has the same constitution as that shown in FIG. 1. Like members as those in FIG. 5 are denoted by like reference numerals. In FIG. 15, reference numeral 31 denotes a control part that controls the decoder; 32, a bus through which control signals from the control part are transmitted; and 36, a decoder for memory reading (RDECO).

Figures 16A, 16B, 16C, 16D, 16E, 16F, 16G, 16H, 16I, 16J, 16K, 16L, 16M, 16N:
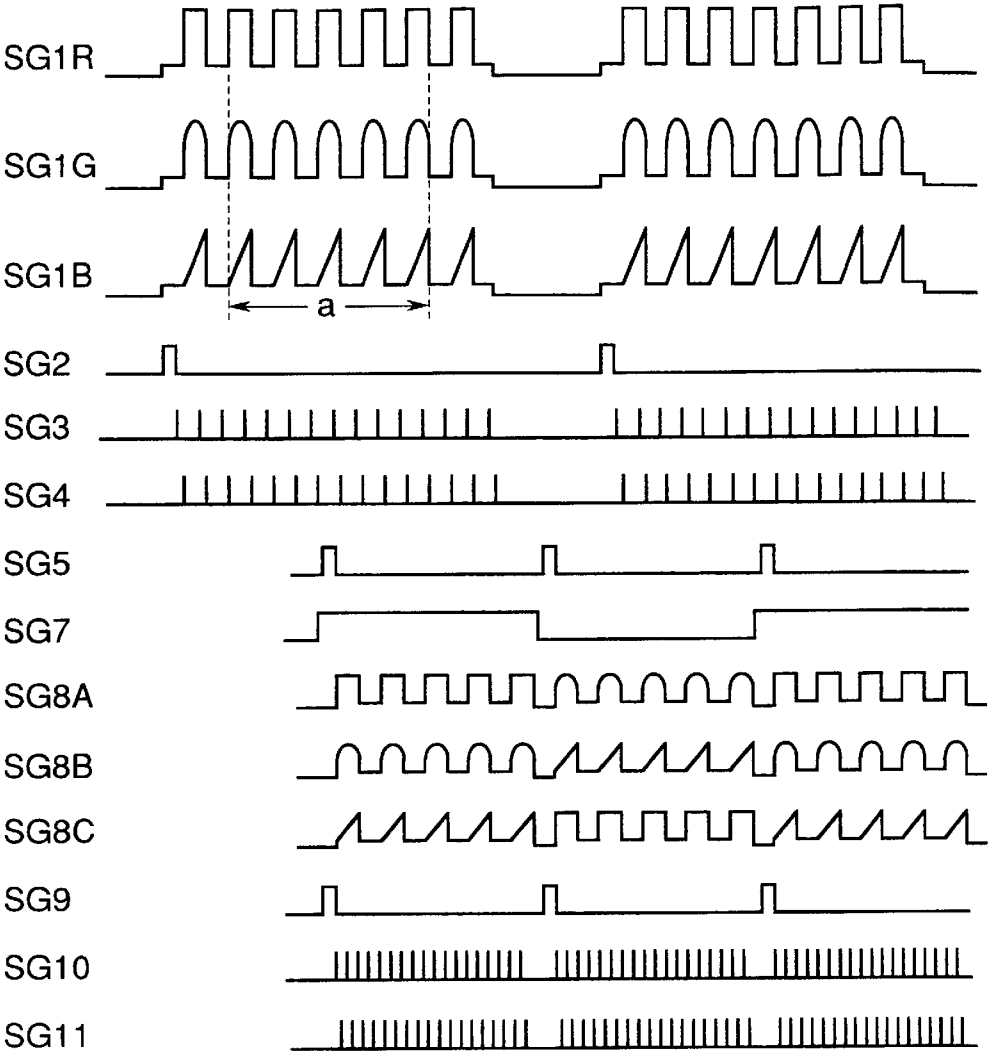
FIGS. 16A to 16N illustrate the drive timings of liquid crystal and memory in Embodiment 2 of the present invention.

FIGS. 16A to 16N illustrate the drive timings of liquid crystal and memory in the present embodiment. FIG. 16A, FIG. 16B and FIG. 16C represent image signals of red, green and blue colors, respectively; FIG. 16D, the WST; FIG. 16E, the WCLK1; FIG. 16F, the WCLK2; FIG. 16G, the RST; FIG. 16H, a color selection switching signal; FIG. 16I to FIG. 16K, signals converted into line-consecutive scanning signals outputted from the memory part, where in this embodiment a picture is enlarged in the horizontal direction by reading part (part a) of the signal during the horizontal scanning period, stored in the memory. FIG. 16L represents the HST; FIG. 16M, the H1; and FIG. 16N, the H2. The X decoder control pulse is not shown here.

Figure 17A:
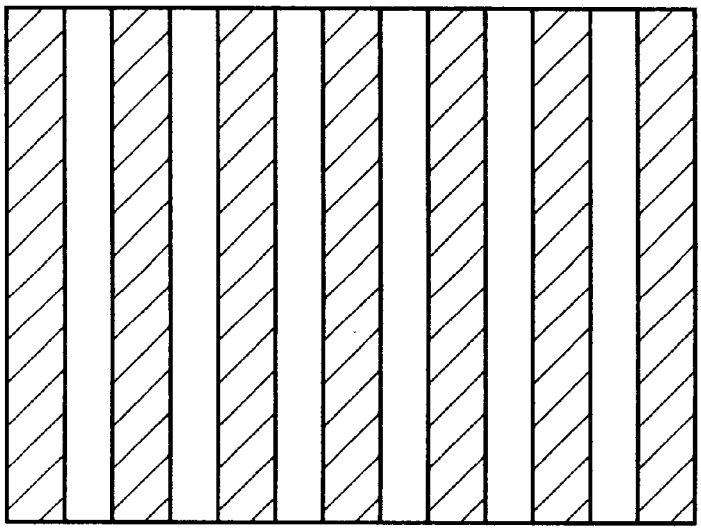
FIGS. 17A and 17B diagrammatically illustrate images obtained in Embodiment 2 of the present invention and an original signal image thereof.
Figure 17B:
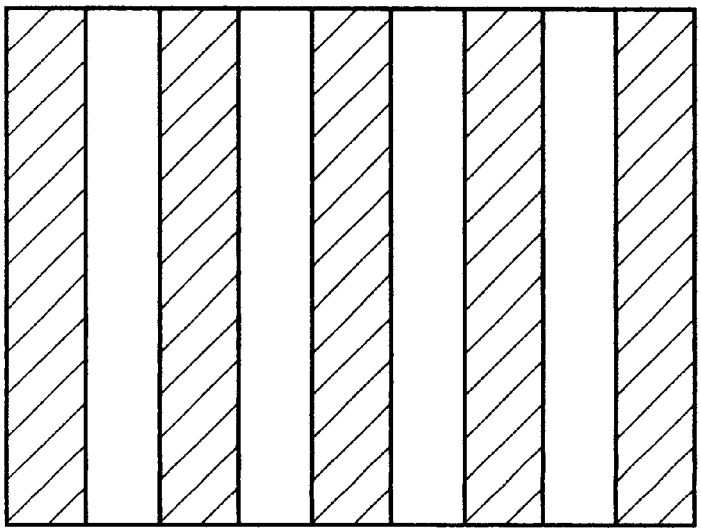

FIGS. 17A and 17B diagrammatically illustrate an original signal image (FIG. 17A) and an image enlargement achieved by the present embodiment (FIG. 17B).

As in the present embodiment, the order of a memory reading means and a memory writing means is changed, and line memories are used which are so constituted that the drive frequency and start position of the shift register are changed. Thus, special image display such as enlargement or reduction of images in the lateral direction and right-to-left reversal or movement of images can be achieved with ease even when the system has low-cost and simple line memories.

Embodiment 3

Figure 19:
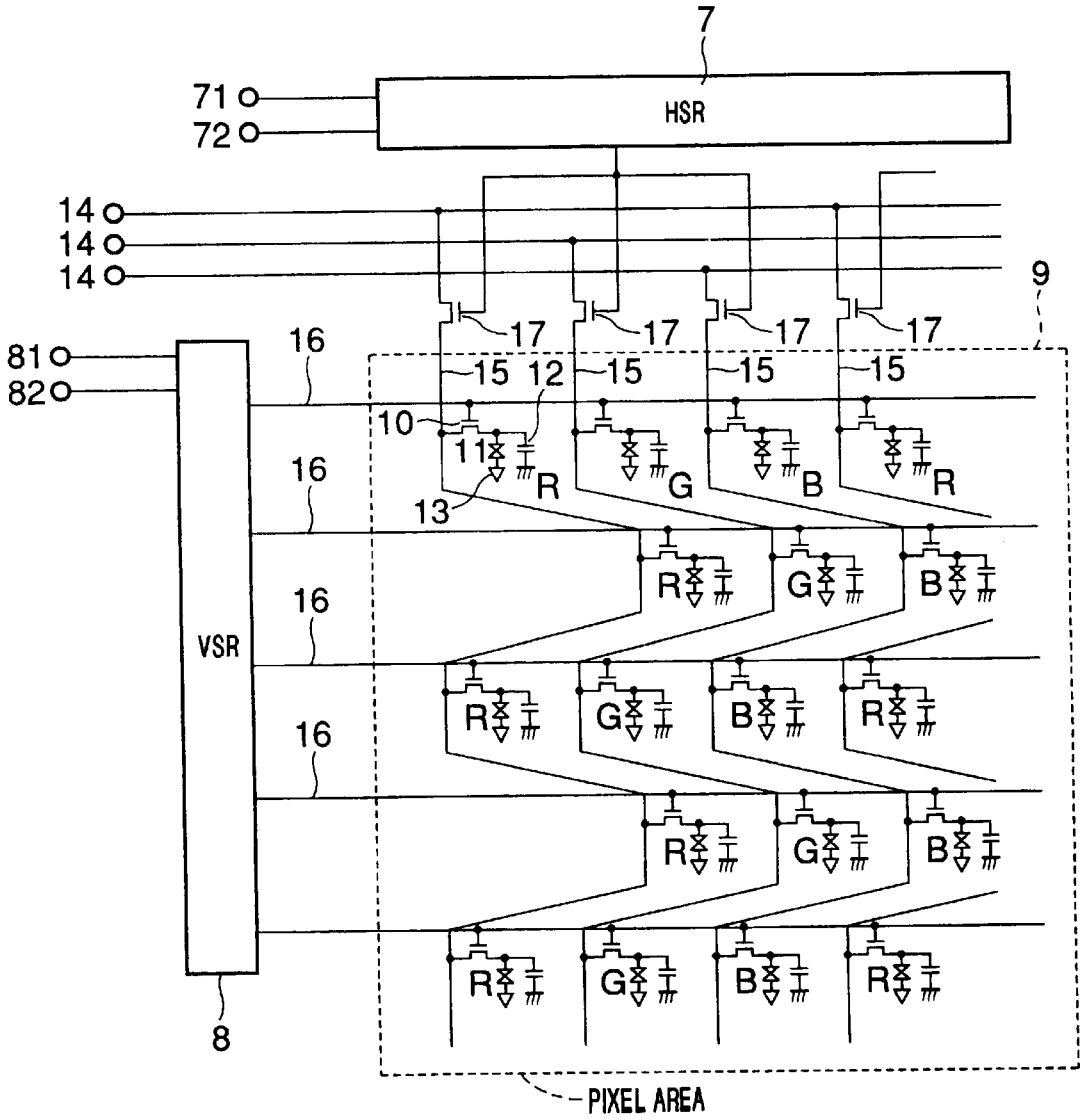
FIG. 19 illustrates a liquid-crystal display panel used in Embodiment 3 of the present invention.
Figure 20:
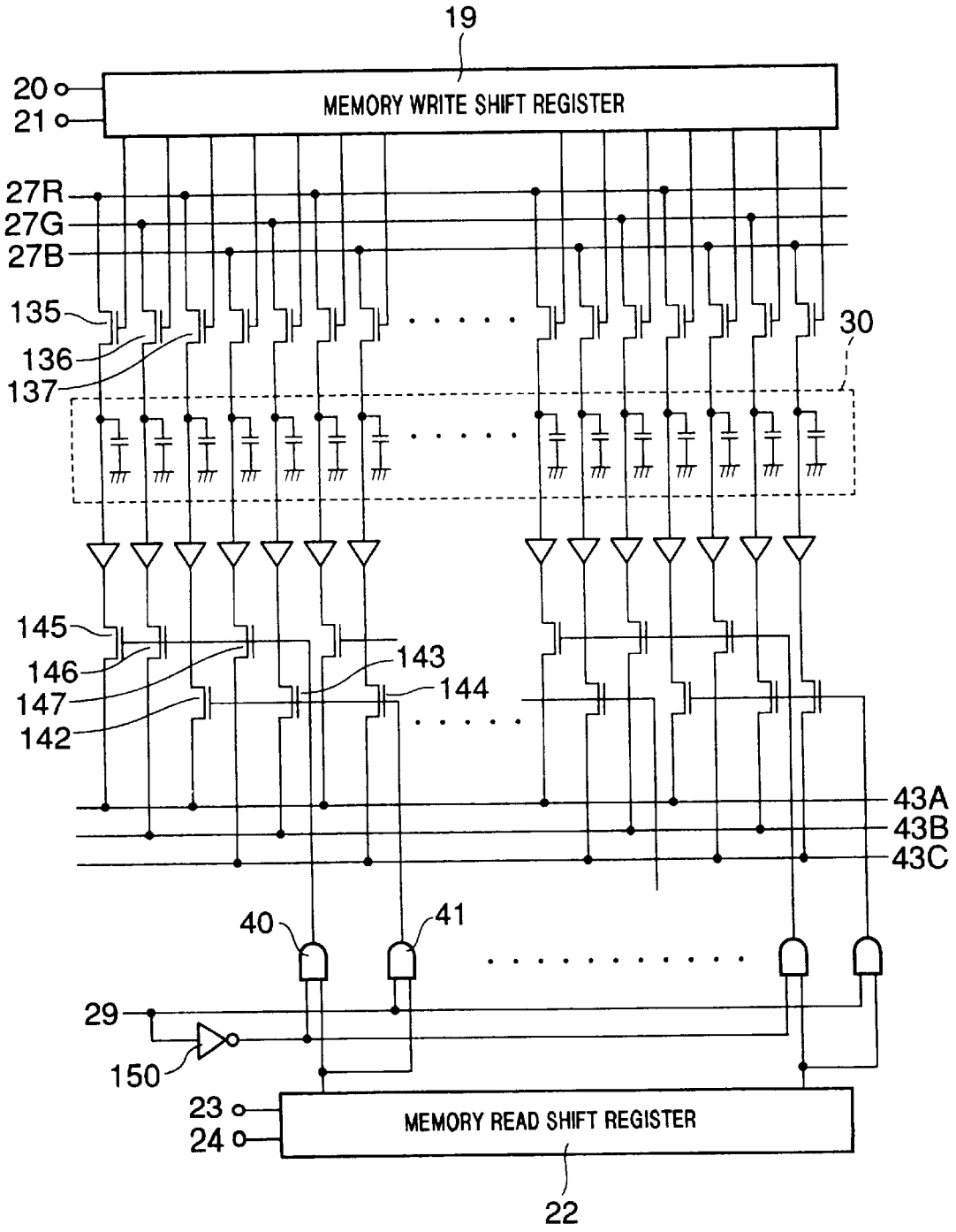
FIG. 20 illustrates an analog memory used in Embodiment 3 of the present invention.

In Embodiment 3, the liquid-crystal display panel is constituted as shown in FIG. 19, where pixels with the same color are connected to data signal lines. In this instance, the line memories may be wired on the reading side as shown in FIG. 20.

In the present embodiment, as image signal hold means, capacitors are used to hold image signals in the state of analog signals (line memories 30 in FIG. 10). This part, however, may be made up using an analog-digital converter, a digital line memory and a digital-analog converter.

As in the present embodiment also, the order of a memory reading means and a memory writing means is changed, and line memories are used which are so constituted that the drive frequency and start position of the shift register are changed. Thus, special image display such as enlargement or reduction of images in the lateral direction and right-to-left reversal or movement of images can be achieved with ease even when the system has low-cost and simple line memories.

What is claimed is:

1. A drive circuit for a color display device comprising a plurality of pixels which are wired in matrix through a plurality of data signal lines and a plurality of scanning signal lines, said drive circuit comprising:

an input means for sampling three-primary color image signals for one line which are inputted through three input lines during a given period t, to write the signals in a memory; and an output means for reading the three-primary color image signals sequentially from the memory during a certain t/2 period to output the signals to three output lines, and reading the three-primary color image signals sequentially from the memory during an additional t/2 period different from the certain t/2 period to output the signals to the three output lines, wherein said certain t/2 period overlaps with said period t, and wherein said output means outputs the three-primary color image signals to the three output lines using different line memories between said certain t/2 period and said additional t/2 period.

2. The drive circuit according to claim 1, wherein said memory is an analog memory.

3. The drive circuit according to claim 1, wherein said given period t is one horizontal scanning period.

4. The drive circuit according to any one of claim 1, 2 or 3, wherein said certain t/2 period and said additional t/2 period are continuous.

5. The drive circuit according to claim 1, wherein said output means outputs image signals with the same three-primary colors to the three output lines during said certain t/2 period and said additional t/2 period.

6. The drive circuit according to claim 5, wherein pixels on adjoining two lines connected to the same data wiring of said color display device have the same colors.

7. The drive circuit according to claim 1, wherein pixels on adjoining two lines connected to the same data wiring of said color display device have different colors.

8. The drive circuit according to claim 6 or 7, wherein pixels on adjoining two lines of said color display device are arranged in shifts of 1.5 pixels.

9. The drive circuit according to claim 8, wherein image signals outputted during said certain t/2 period and said additional t/2 period are outputted matchingly to the pixels arranged in shifts of 1.5 pixels.

10. The drive circuit according to claim 1, wherein in said input means the latter half ½ t period of period t during which said image signals are sampled and written in the memory overlaps with said certain ½ t period.

11. The drive circuit according to claim 1, wherein said image signals outputted to said output lines are outputted to said data signal lines in parallel.

12. The drive circuit according to claim 1, wherein said color display device is an active matrix liquid-crystal display device in which said plurality of pixels each have a switching element.

13. The drive circuit according to claim 12, wherein said switching element is a thin-film transistor comprising a polycrystalline silicon.

14. A drive circuit for a color display device comprising a plurality of pixels which are wired in matrix through a plurality of data signal lines and a plurality of scanning signal lines, said drive circuit comprising:

an input means for sampling three-primary color image signals for one line which are inputted through three input lines during a given period t, to write the signals in a memory; and an output means for reading the three-primary color image signals sequentially from the memory during a certain t/2 period to output the signals to three output lines, and reading the three-primary color image signals sequentially from the memory during an additional t/2 period different from the certain t/2 period to output the signals to the three output lines, wherein said certain t/2 period overlaps with said period t, so as to effect micro-adjustment of the timing of reading from said memory, matchingly to pixel arrangement of said color display device, said micro-adjustment corresponding to a phase difference between a phase of charging a capacitance associated with the display and a phase of period per one pixel of the signals inputted by said input means.

15. A drive circuit for a color display device comprising a plurality of pixels which are wired in matrix through a plurality of data signal lines and a plurality of scanning signal lines, said drive circuit comprising:

an input means for sampling three-primary color image signals for one line which are inputted through three input lines during a given period t, to write the signals in a memory; and an output means for reading the three-primary color image signals sequentially from the memory during a certain t/2 period to output the signals to three output lines, and reading the three-primary color image signals sequentially from the memory during an additional t/2 period different from the certain t/2 period to output the signals to the three output lines, wherein said certain t/2 period overlaps with said period t, and wherein image signals on an n-th line of the odd-numbered field are written in a 2n+1 line and 2n+2 line of said plurality of pixels, and image signals on the n-th line of the even-numbered field are written in the pixels on a 2n line and the 2n+1 line.

* * * * *